US005614085A

United States Patent [19]

Platt, III

[11] Patent Number: 5,614,085

[45] Date of Patent: Mar. 25, 1997

[54] OMNIDIRECTIONAL SKIMMER

[76] Inventor: James B. Platt, III, 12826 Dover Rd., Reisterstown, Md. 21136

[21] Appl. No.: 500,619

[22] Filed: Jul. 11, 1995

[51] Int. Cl.[6] ..... E04H 11/16

[52] U.S. Cl. ..... 210/169; 210/232; 210/238; 210/242.1

[58] Field of Search ..... 210/169, 232, 210/237, 238, 242.1, 470, 776; 4/490, 496

[56] References Cited

U.S. PATENT DOCUMENTS

| | | | |
|---|---|---|---|
| 3,863,237 | 1/1975 | Doerr | 210/169 |
| 4,053,412 | 10/1977 | Stix | 210/169 |
| 4,518,495 | 5/1985 | Harding | 210/169 |
| 4,889,622 | 12/1989 | Newcombe-Bond | 210/242.1 |
| 4,994,178 | 2/1991 | Brooks | 210/169 |
| 5,043,060 | 8/1991 | Brennan | 210/122 |
| 5,139,660 | 8/1992 | Lourie et al. | 210/169 |
| 5,223,135 | 6/1993 | MacPhee et al. | 210/242.1 |
| 5,350,508 | 9/1994 | Van Der Watt | 210/169 |
| 5,422,001 | 6/1995 | Yagoda et al. | 210/169 |
| 5,454,940 | 10/1995 | Lakotish | 210/169 |

*Primary Examiner*—Peter A. Hruskoci
*Assistant Examiner*—Theodore M. Green
*Attorney, Agent, or Firm*—Foley & Lardner

[57] ABSTRACT

An omnidirectional skimmer for removing debris from the surface of a liquid includes a first flotation member, a second flotation member, first and second hollow cross-members and a net operatively connected to the first and second hollow cross-members. The first and second hollow cross-members have open ends such that in operation one of the cross-members is submerged in water and therefore filled with water, while the other cross-member is above the surface of the water and therefore empty. The hollow open cross-members and an omnidirectional pulling element allow the pool skimmer to be operated in any direction regardless of orientation. For example, the pool skimmer can be flipped over and still operated, or the net of the pool skimmer can be inverted while the pool skimmer maintains operational effectiveness.

19 Claims, 12 Drawing Sheets

OMNIDIRECTIONAL SKIMMER

BACKGROUND OF THE INVENTION

The invention relates to skimmers for use in cleaning debris from, at or near the surface of a liquid. In particular, the invention is useful as a pool skimmer for skimming debris off the surface of water contained within a swimming pool.

Conventional swimming pool skimmers are either too small, and therefore labor intensive, or large and bulky, and thus designed to be pulled in only one direction. Such skimmers are therefore difficult to maneuver within a swimming pool, and are especially difficult to operate when one cleans debris from inside the skimmer.

U.S. Pat. No. 4,518,495, issued to Harding, provides one form of conventional skimmer. Harding's pool skimmer can only be pulled in one direction. Also, if Harding's pool skimmer is flipped over, it will no longer be operational.

U.S. Pat. No. 5,043,060, issued to Brennan, provides another form of conventional pool skimmer. Brennan's skimmer has three elongated connecting members. Two of these connecting members are at the front of the skimmer. These two connecting members are filled with air and sealed to allow Brennan's skimmer to float. Brennan's third connecting member, which is at the back of the skimmer, has a plurality of apertures, allowing it to sink in water. Like Harding's skimmer, Brennan's skimmer is designed to be pulled only in the direction it is facing. Further, if the net in Brennan's skimmer is inverted, Brennan's skimmer will no longer be operational.

It is an object of the invention to provide a swimming pool skimmer which is omnidirectional in nature, i.e., it can be pulled in multiple directions or upside down.

It is a further object of the invention to provide a pool skimmer containing a net which can be inverted in order to clean debris therefrom, and which, when the net is inverted, can be immediately used as a pool skimmer without returning the net to its previous uninverted configuration.

It is a further object of the invention to provide a pool skimmer which is easy to assemble and disassemble, preferably without the need for tools.

It is a further object of the invention to provide a pool skimmer which is light weight and has soft outer surfaces, such that the outer surfaces will not damage a pool when dragged against the pool during a cleaning operation or cause injury to users or people in the pool when the pool skimmer is operated.

SUMMARY OF THE INVENTION

A pool skimmer according to the invention includes two flotation members, designated herein as a first flotation member and a second flotation member, two cross-members, designated herein as a first cross-member and a second cross-member, and a net operatively connected to the first and second cross-members. The two cross-members are hollow, and each has a first end connected to the first flotation member and a second end connected to the second flotation member.

Preferably, each of the flotation members contains through-holes within which corresponding ends of the cross-members are positioned such that an open end of each cross-member is substantially open to an outside surface of one of the flotation members.

The invention further provides an omnidirectional pulling element coupled to the first and second flotation members. One example of such an element includes a traverse line connected between a first end section and a second end section of each flotation member. The omnidirectional pulling element may further include a traversing line which is slidably connected at one end to at least one of the traverse lines. In one example, the traversing line is slidably connected at each end to a traverse line of one of the two flotation members.

An alternative omnidirectional pulling element includes a traverse slot connected between the first end section and the second end section of the flotation member. Such an omnidirectional pulling element further comprises a traversing line slidably connected at one end to the traverse slot of one flotation member. The traversing line may also comprise a slidable connection at its other end with a traverse slot of the other flotation member.

A pool skimmer according to the invention can further include a plurality of support members connected to or integral with one or more of the ends of the hollow cross-members. The support members facilitate connection of the hollow cross-members to the flotation members. In one example, an inner support member and an outer support member are provided for an end of one of the cross-members.

The inner support member contacts an inner surface of the flotation member, and the outer support member contacts an outer surface of the flotation member. The flotation member is thus sandwiched between the inner and outer support members.

Each of the inner and outer support members has a substantially perpendicular orientation with respect to a longitudinal axis of the cross-member. The inner support member and the outer support member thus maintain the cross-member in a corresponding through-hole of one of the flotation members. For example, an inner support member may include a shoulder built into a cross-member while an outer support member may include a nut threadably engaged with an end of the cross-member. Alternatively, the inner support member and the outer support member can include dowels positioned in corresponding through-holes contained within the cross-member.

The net of the pool skimmer according to the invention may include a first hem at a first end and a second hem at a second end. The first and second hems can each have an opening to provide an operative connection between the net and the first and second cross-members. The net can have various lengths. However, it is preferable that the net have a length sufficient to keep debris within the net when an operator stops pulling the pool skimmer through the water or turns the pool skimmer in the water. For example, a length of the net which is approximately the length of a flotation member, approximately 18 inches, has been found to be effective.

Preferably, the flotation members have a symmetrical shape which resembles an elongated longitudinal shape with a center portion expanded laterally with respect to a longitudinal axis. Further, the flotation members preferably have round ends and a tapered center portion. Dimensionally, the depth of the center portion is preferably at least 1.5 times, and more preferably approximately two times, that of the end sections.

Exemplary materials used for a pool skimmer according to the invention include the use of hollow plastic, rubber inflatables, or any foam which is compatible with water, such as cross link polyethylene foam, for the flotation members, and the use of PVC pipe for the cross-members. Other suitable materials may be substituted while remaining within the scope of the invention.

BRIEF DESCRIPTION OF THE DRAWINGS

The aforementioned and other objects and advantages of the invention are explained in the following description in view of the drawings, wherein.

DETAILED DESCRIPTION

Figure 1:
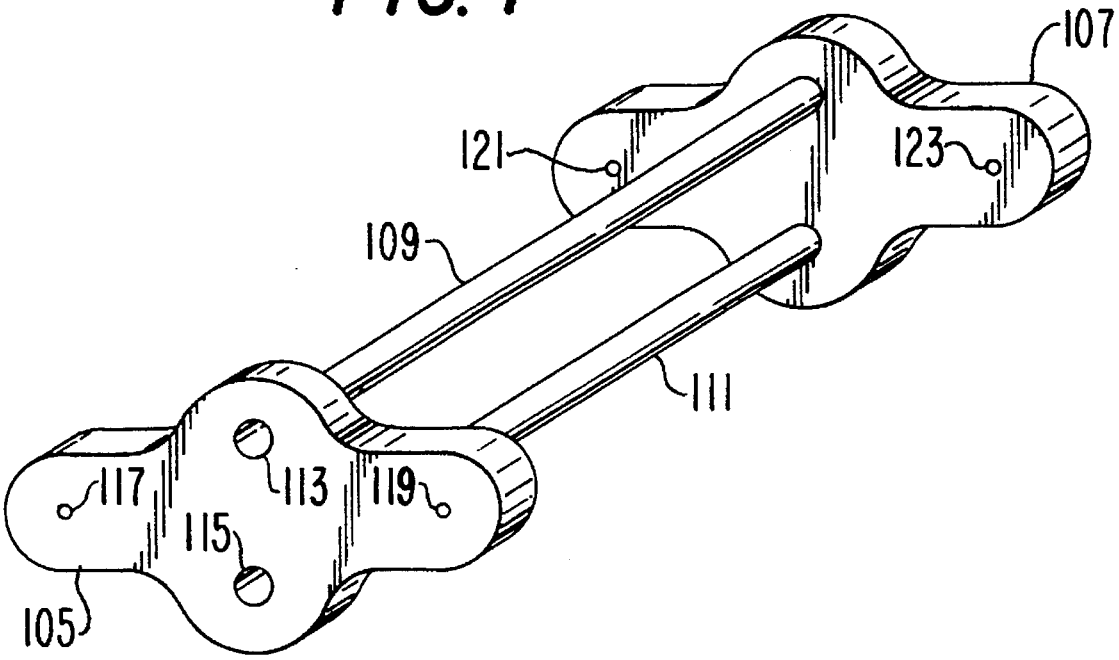
FIG. 1 shows an example of flotation members and cross-members of a first embodiment according to the invention.

FIG. 1 shows flotation members 105 and 107 of a first embodiment of the invention interconnected by first and second hollow cross-members 109 and 111. As shown, cross-members 109 and 111 are open at their ends, such as at ends 113 and 115 respectively. Also, as shown, the open ends of cross-members 109 and 111 are positioned within corresponding through-holes in flotation members 105 and 107 such that the open ends of cross-members 109 and 111 are substantially open with respect to an outer surface of flotation members 105 and 107.

In addition to the through-holes that accommodate the cross-members, the flotation members of the first embodiment each include two additional through-holes. For example, flotation member 105 contains through-holes 117 and 119, and flotation member 107 contains through-holes 121 and 123.

Figure 2:
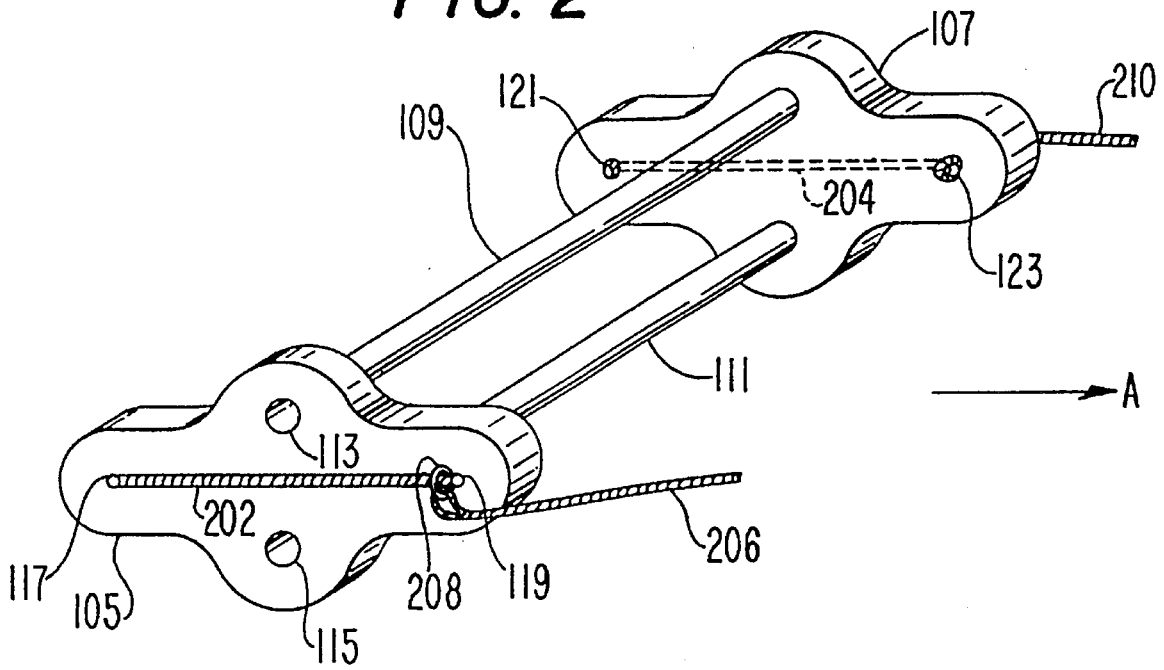
FIG. 2 shows an example of an omnidirectional pulling element, comprising two traverse lines and a traversing line, integrated into the first embodiment according to the invention.

As shown in FIG. 2, traverse lines 202 and 204 are respectively connected to flotation members 105 and 107 through through-holes 117/119 and 121/123. Also, traversing line 206 is connected to traverse line 202 by ring 208. Similarly, traversing line 210 is connected to traverse line 204. Alternatively, traversing lines 206 and 210 can comprise a single line connected at one end to traverse line 202 and at another end to traverse line 204.

As shown in FIG. 2, with traversing lines 206 and 210 positioned toward the right, the pool skimmer is configured to move in a direction from left to right across the page, as shown by arrow A. Should one desire to pull the pool skimmer in the opposite direction, traversing lines 206 and 210 can be pulled toward the left (toward through-holes 117 and 121), as they are slidably engaged with traverse lines 202 and 204.

Figure 3:
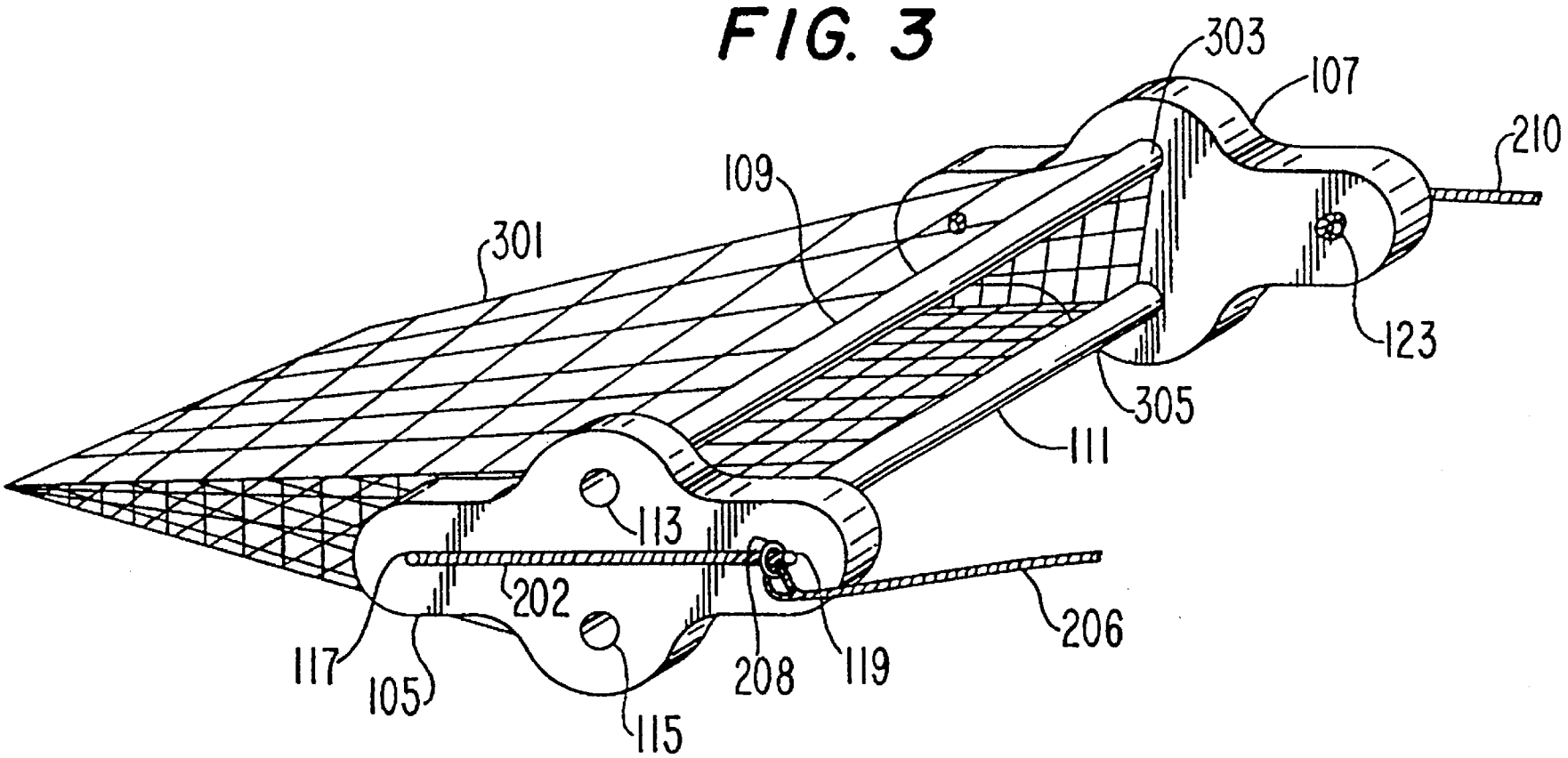
FIG. 3 shows a net incorporated into the first embodiment according to the invention.

FIG. 3 shows net 301 connected to cross-members 109 and 111 by way of hems 303 and 305. Hems 303 and 305 contain openings which envelop cross-members 109 and 111, respectively. For example, cross-members 109 and 111 can be slid into the respective openings of hems 303 and 305 prior to connection with flotation members 105 and 107. In the orientation shown in FIG. 3, the pool skimmer can be pulled toward the right to thereby capture debris within net 301.

Advantageous features of the invention as shown in FIG. 3 include the shape of flotation members 105 and 107 and the hollow nature of cross-members 109 and 111. As shown, flotation members 105 and 107 have a symmetrical shape with an elongated longitudinal shape along a longitudinal axis corresponding to traverse lines 202 and 204. Further, each of flotation members 105 and 107 has a center portion which is expanded in a lateral direction relative to its longitudinal axis. Through-holes 113 and 115 are contained, for example, in the expanded center portion of flotation member 105.

The end sections of flotation members 105 and 107 are rounded and the center portion is tapered. An advantage provided by flotation members of this shape, in conjunction with the open-ended cross-members, is that the pool skimmer has a great level of stability. Further, the largest amount of buoyancy is focused on the portion of the pool skimmer which supports cross-members 109 and 111. As a result, the pool skimmer generally presents a profile wherein the water line is between cross-members 109 and 111 at a point substantially halfway between cross-members 109 and 111. Thus, in the configuration shown in FIG. 3, when in operation, cross-member 111 will be submerged in the water and cross-member 109 will be above the water's surface. Cross-member 111 will therefore be filled with water, which provides stability, and cross-member 109 will be empty.

An operational advantage of the open-ended nature of cross-members 109 and 111 is that the pool skimmer of the invention can be flipped over and still remain operational. For example, if the pool skimmer is operating according to the configuration shown in FIG. 3, moving from left to right across the page, and is then flipped over, to, for example, move from right to left across the page, cross-member 109 will fill with water while cross-member 111 drains. Thus, the pool skimmer will maintain a stable orientation wherein the water line is between the lower cross-member and the upper cross-member.

As described above, if the pool skimmer is pulled to the right as shown in FIG. 3, one can reorient the pool skimmer to be pulled to the left by flipping the pool skimmer over. Alternatively, one can clean debris from the pool skimmer by pulling net 301 between cross-members 109 and 111 to an inverted orientation substantially opposite to that shown in FIG. 3. Once net 301 is inverted in such a manner, one need not reconfigure net 301 by pushing net 301 back through cross-members 109 and 111. Instead, since traversing lines 206 and 210 are slidably connected to traverse lines 202 and 204, net 301 can remain in the inverted position and traversing lines 206 and 210 can be pulled to the opposite ends of traverse lines 202 and 204, such as to positions proximate to through-holes 117 and 121. The pool skimmer of the invention can then be operated in a direction from right to left across the page in FIG. 3. Thus, the invention enables two scenarios by which the pool skimmer of the invention can make a 180 degree change in direction. In the first scenario, the pool skimmer is flipped over. In the second scenario, the net of the pool skimmer is pulled into an inverted orientation relative to the cross-members supporting the net.

In the example shown in FIG. 3, net 301 has a length, measured from its opening to its rearmost point, which is greater than the longitudinal lengths of flotation members 105 and 107. This is purely by way of example and not of limitation. Any net length is within the scope of the invention. However, it has been found that a net length substantially equal to the longitudinal length of the flotation members is sufficient for keeping debris within the net while the pool skimmer is operated. More specifically, a net length of 18 inches has been found to be very effective. Any type of net may be used. For example, a net of flexible fiberglass screening has been found to be effective.

The flotation members are made from a material that floats, preferably cross link polyethylene foam. An example of an effective flotation member consists of two pound density foam laminated on either side with a 6 pound foam laminate. The greater density (6 pound) laminate provides increased rigidity while the two pound density foam provides sufficient cushioning and flexibility.

Cross-members 109 and 111 can be made from polyvinyl chloride (PVC) pipe of an appropriate diameter, such as 1 inch or 1.5 inches. Further, to prevent tearing of the flotation members, through-holes 117 and 119 can be constructed with an insert, such as a ½ inch diameter PVC pipe insert. Hems 303 and 305 should be substantially rigid to prevent bunching of net 301 toward one flotation member or the other. For example, a vinyl tube sewed to net 301 and then slid over cross-member 303 and 305 has been found to be effective. Such a vinyl tube, by preventing bunching of the net, maintains the operational effectiveness of the pool skimmer by keeping the net evenly distributed between flotation members 105 and 107. Further, the vinyl tube protects the net from tears due to, for example, contact with the ground or sharp objects. The net can also be attached to the cross-members or flotation members with clips or other suitable fasteners to maintain the net's position and prevent bunching.

The rings, such as ring 208 which slidably connects traversing line 206 to traverse line 202, can be, for example, made from plastic or rust-proof metal. A configuration similar to a conventional key ring has been found to be effective. As with the other materials described above, these materials are merely provided by way of example and not by way of limitation.

Figure 4:
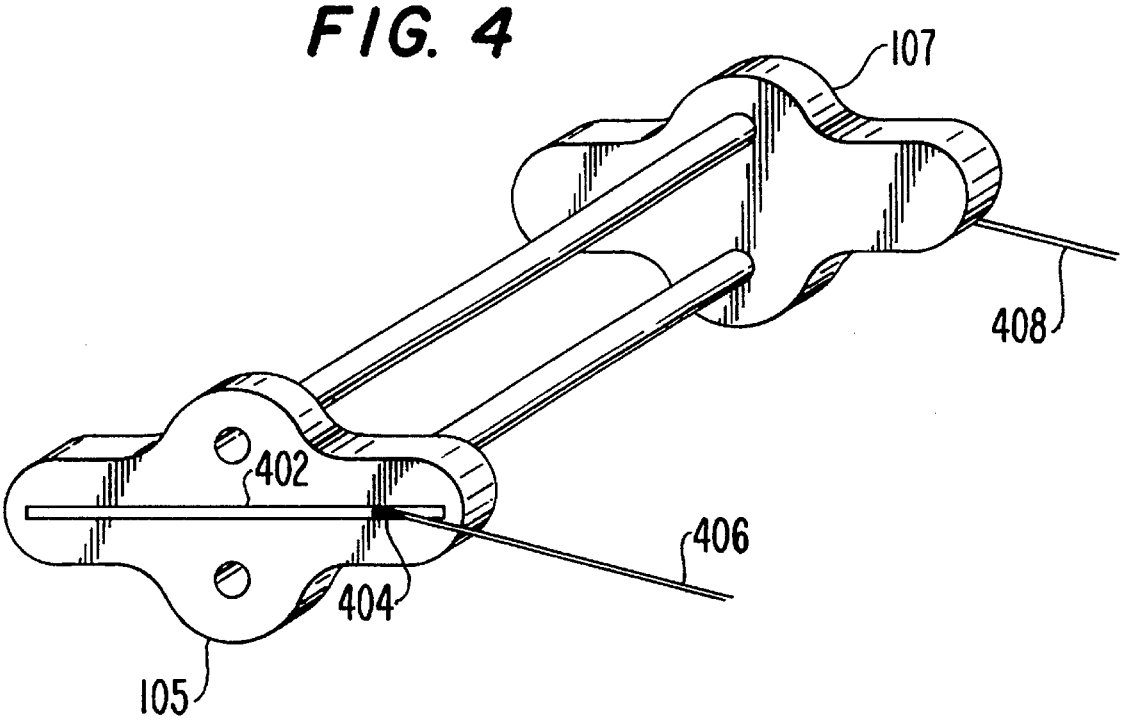
FIG. 4 shows an omnidirectional pulling element according to a second embodiment of the invention.

FIG. 4 shows an alternative embodiment of the invention wherein the omnidirectional pulling element comprises slot 402 integrated into flotation member 105, and peg 404 connected to an end of traversing line 406 and slidably engaged within slot 402. Flotation member 107 contains a similar slot such that a similar peg connected to traversing line 408 is slidably engaged therein. A pool skimmer constructed according to the configuration of FIG. 4 would thus provide operational advantages similar to those provided by the pool skimmer shown in FIG. 3.

Figure 5:
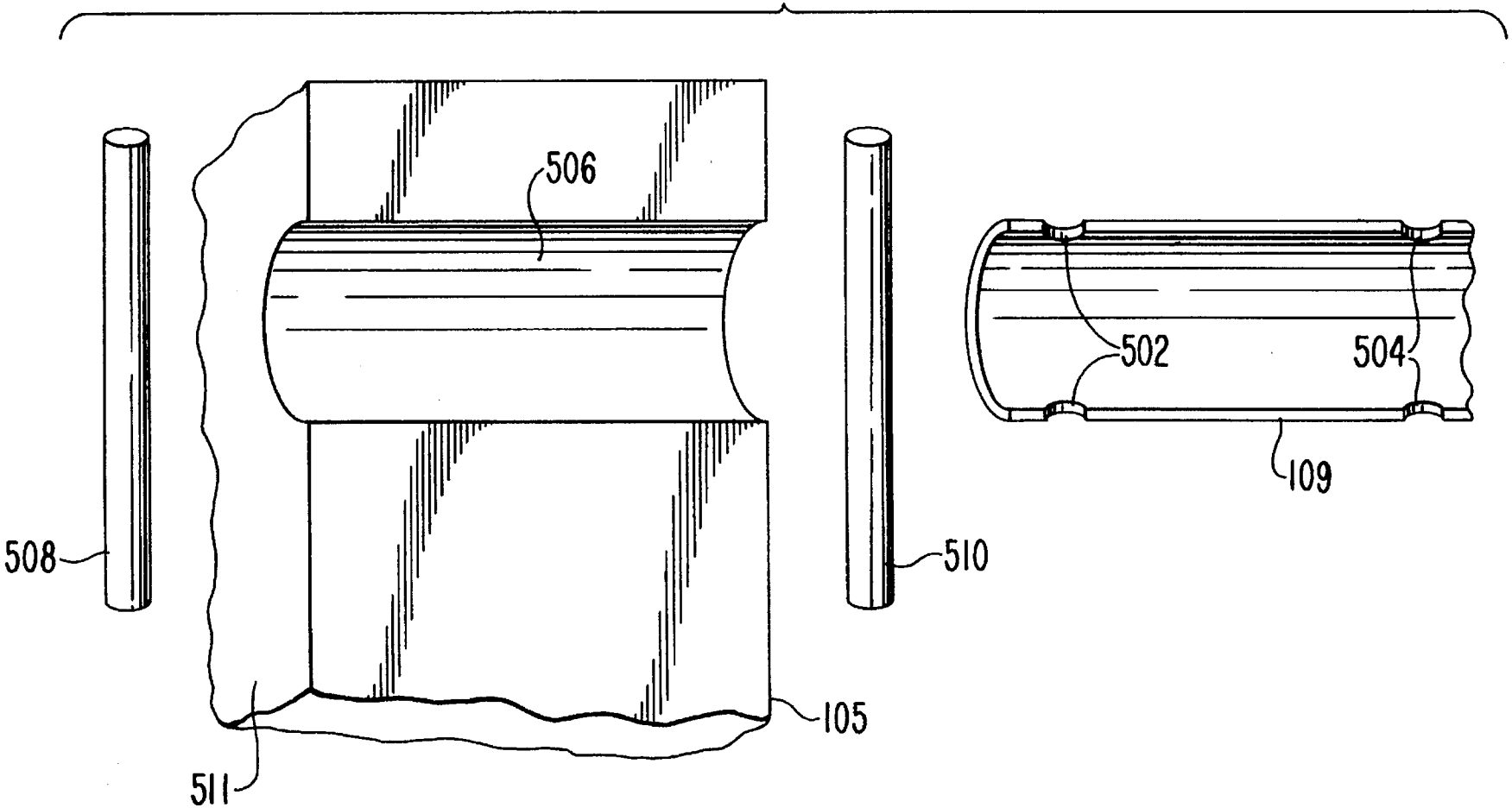
FIG. 5 shows an example of a connection between a cross-member and a flotation member according to a third embodiment of the invention.
Figure 5A:
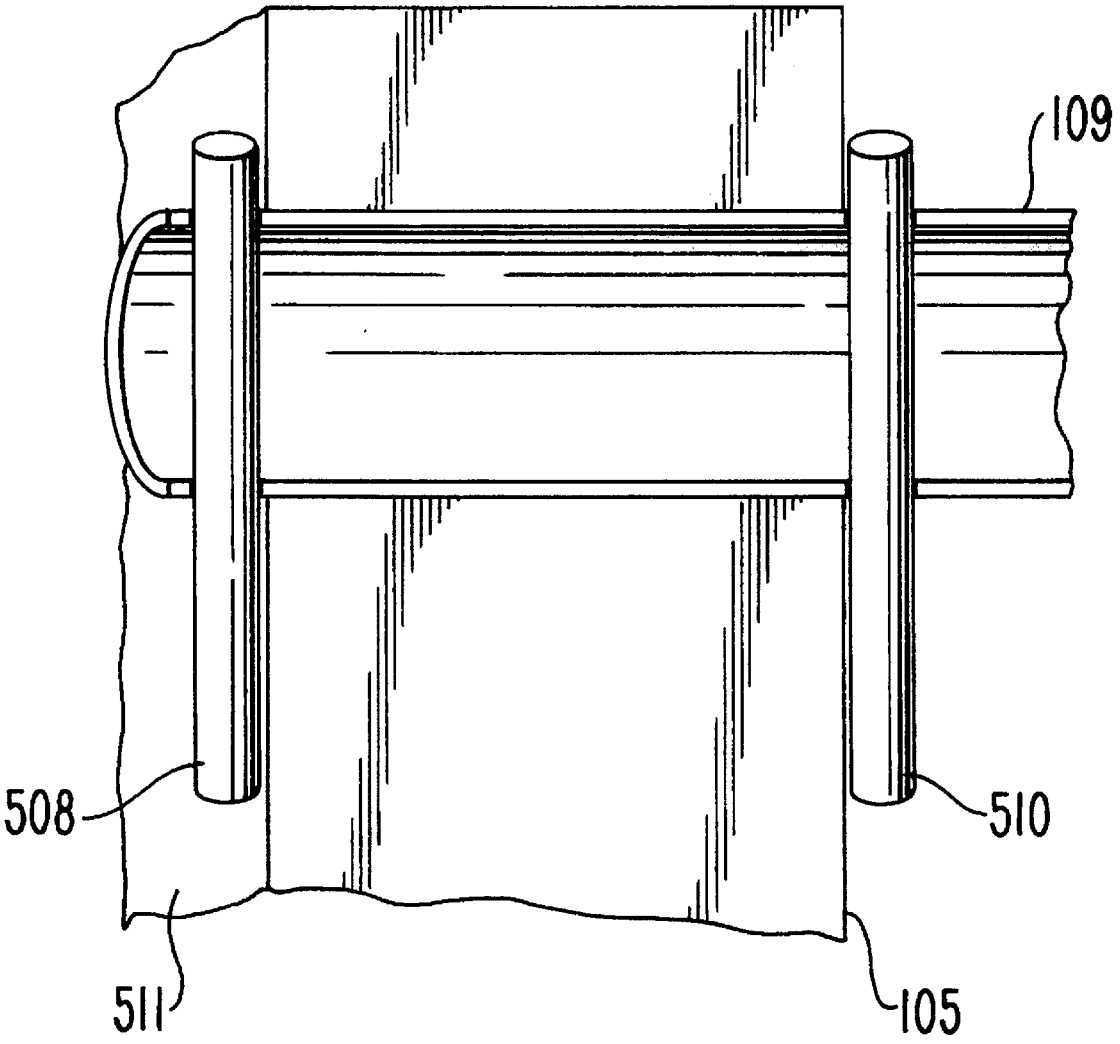
FIG. 5A shows the example of FIG. 5 in a connected configuration.

As discussed above, the pool skimmer of the invention has cross-members with open ends which are open to outer surfaces of the flotation members. FIGS. 5–8 show examples of a connection between a hollow cross-member and a flotation member. The examples show a cross-sectional view of the connection between cross-member 109 and flotation member 105. Similar structure can be employed for connecting cross-member 109 to flotation member 107 and for connecting cross-member 111 to flotation members 105 and 107. In the examples of FIGS. 5 and 7, the flotation member is compressed or sandwiched between two members or surfaces. These examples are not provided by way of limitation, but merely by way of illustration. Thus, any device which sandwiches the flotation members between two members or surfaces is intended to be within the scope of the invention.

For example, FIG. 5 shows a method of connecting cross-member 109 to flotation member 105. A similar method can be used to connect cross-member 109 to flotation member 107 and to connect cross-member 111 to flotation members 105 and 107. As shown in FIG. 5, cross-member 109 contains two through-holes 502 and 504. Also, flotation member 105 contains through-hole 506 into which cross-member 109 can be positioned. Also provided are dowels 508 and 510 for positioning in through-holes 502 and 504 respectively. When positioned in through-holes 502 and 504, dowels 508 and 510 act as two members which compress flotation member 105.

Operationally, dowel 510 is inserted into through-hole 504 of cross-member 109. Cross-member 109 is then inserted into through-hole 506 such that through-hole 502 of cross-member 109 is positioned proximate to outer surface 511 of flotation member 105. Dowel 508 is then inserted into through-hole 502 to hold cross-member 109 within through-hole 506 of flotation member 105.

Figure 5B:
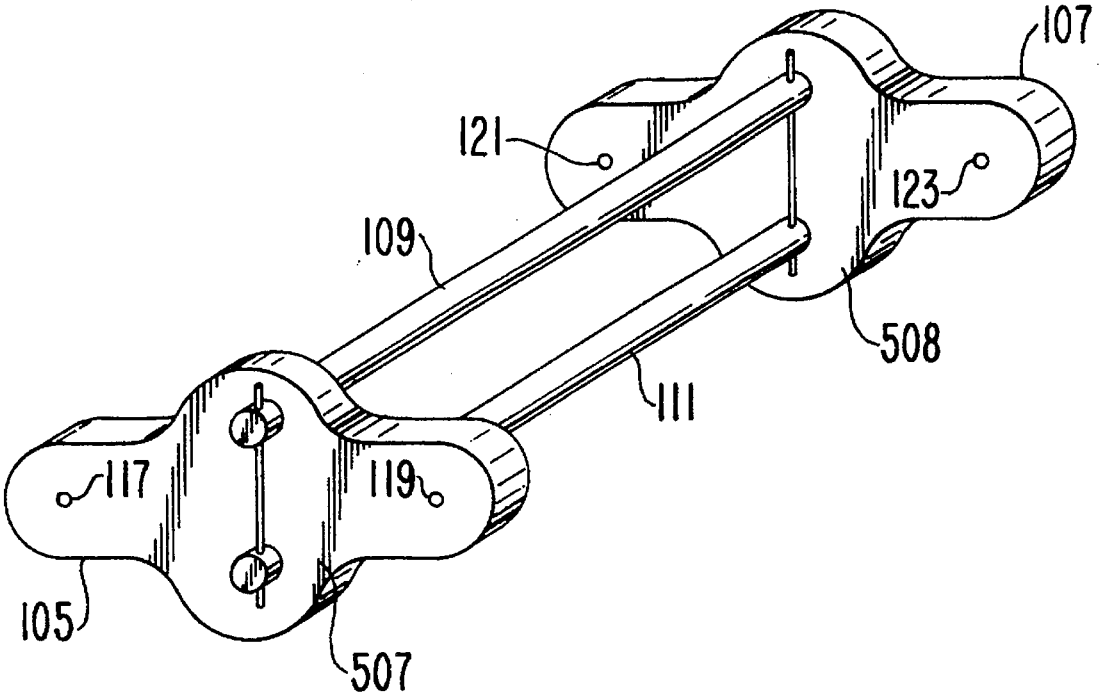
FIG. 5B shows an alternative example of the embodiment of FIG. 5.

Preferably, the distance between through-holes 502 and 504 is slightly less than the diameter of flotation member 105 (i.e., the length of through-hole 506). As a result, flotation member 105 must be compressed in order to insert dowel 508 into through-hole 502. Compressional and frictional forces between flotation member 105 and dowels 508 and 510 will therefore maintain a tight fit to keep cross-member 109 properly positioned in through-hole 506. For example, a distance between through-holes 502 and 504 of ¼ inch less than the length of through-hole 506 has been found to be effective. Cross-member 109 can be, for example, a PVC pipe of 1 to 1½ inches diameter and dowels 508 and 510 can be plastic dowels of a length sufficient to fit through corresponding through-holes 502 and 504 and provide sufficient surface friction with the surfaces of flotation member 105. The through-holes 502 and 504 can be in any orientation along planes which are perpendicular to the longitudinal orientation of the cross-members. In the example of FIG. 5, the through-holes are oriented such that an extension of the dowels along their longitudinal orientation would intersect cross-member 111. Thus, the example discussed above, which requires two dowels for each connection between a cross-member and a flotation member, thereby requiring a total of eight dowels for the four cross-member to flotation member connections, can be slightly modified to use a total of only four dowels. To accomplish this, each cross-member 109 and 111 should be configured to have through-holes, such as through-holes 502 and 504, which are in alignment with matching through-holes of the other cross-member, such that a single dowel can engage with the aligned through-holes of both cross-members 109 and 111. An example is shown in FIG. 5B, where dowels 506 and 508 are inserted into through holes in cross-members 109 and 111 at the outside surface of flotation member 105 and at the inside surface of flotation member 107 respectively. Similar dowels, which are not visible in the figure, are at the inside surface of flotation member 105 and the outside surface of flotation member 107.

Figure 6:
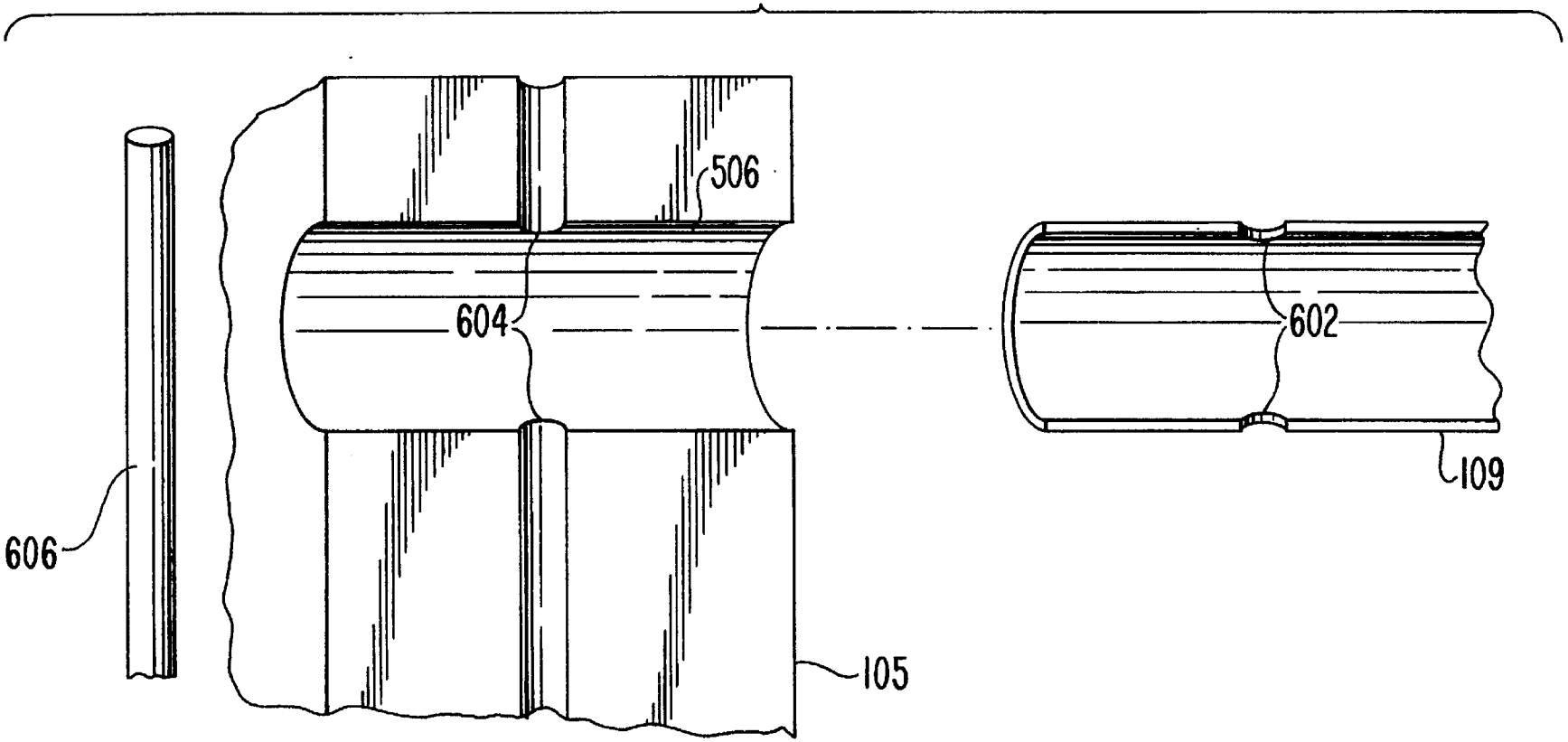
FIG. 6 shows an alternative example of a connection between a cross-member and a flotation member according to a fourth embodiment of the invention.
Figure 6A:
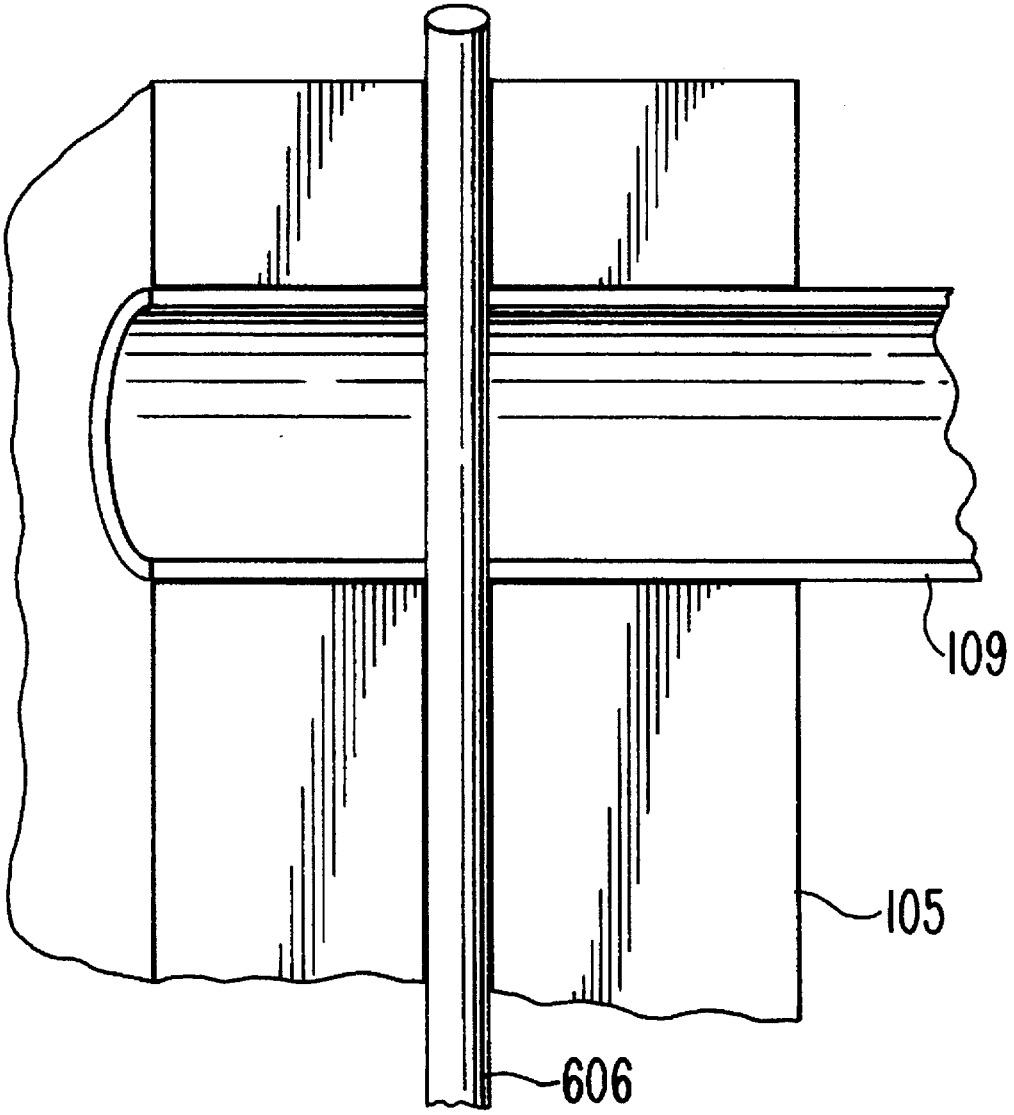
FIG. 6A shows the example of FIG. 6 in a connected configuration.
Figure 7:
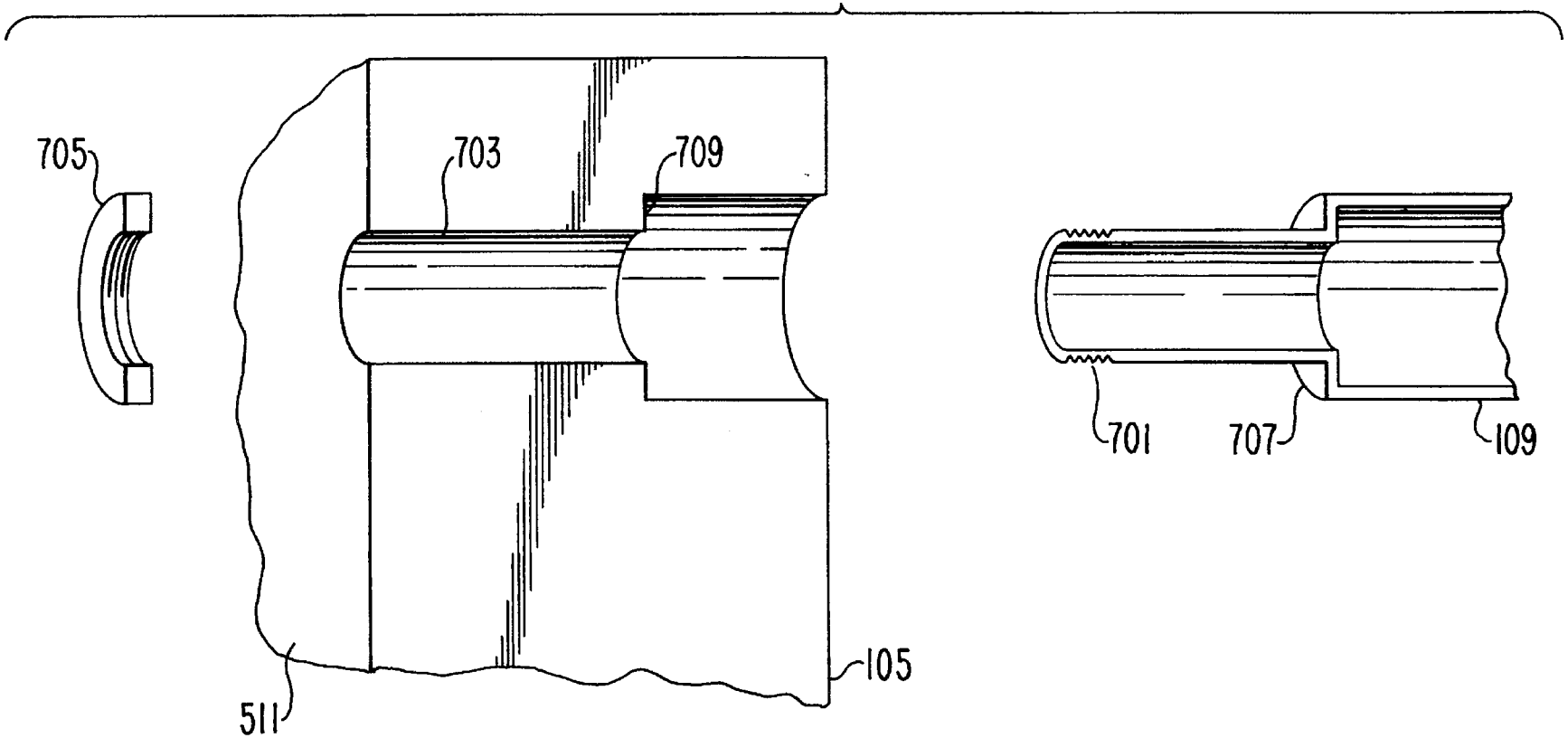
FIG. 7 shows an alternative example of a connection between a cross-member and a flotation member according to a fifth embodiment of the invention.
Figure 7A:
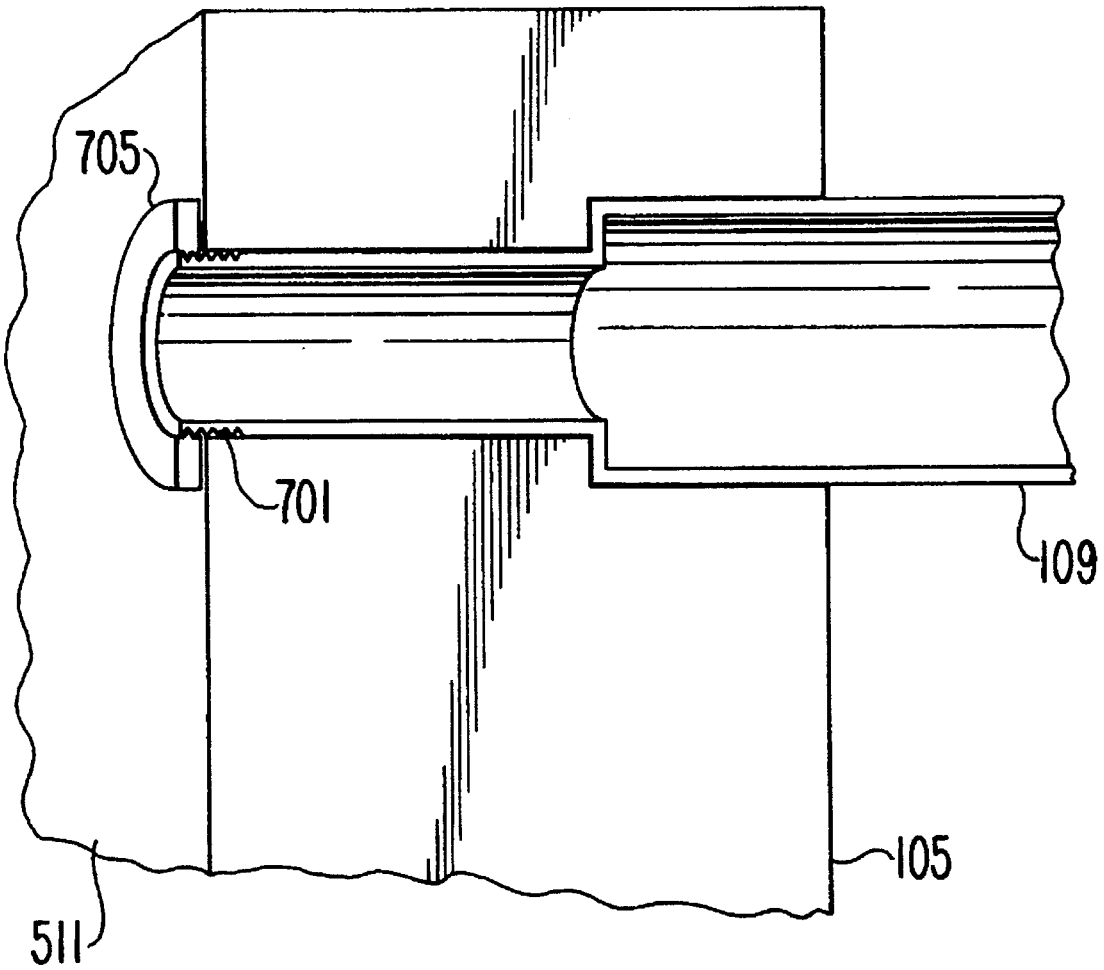
FIG. 7A shows the example of FIG. 7 in a connected configuration.

In another alternative, shown in FIG. 6, all of the connections can be made using a total of only two dowels. As shown in FIG. 6, cross-member 109 has a through hole 602 which, when cross-member 109 is inserted into through-hole 506 of flotation member 105, aligns with through-hole 604. Cross-member 111 (not shown) would have a similar construction. Dowel 606 can be press-fitted into through-hole 604 and through-holes 602 of cross-members 109 and 111 to interconnect cross-members 109 and 111 to flotation member 105. At the other ends of cross-members 109 and 111, a similar construction can be used to interconnect cross-members 109 and 111 to flotation member 107.

FIG. 7 shows an alternative interconnection between a cross-member and a flotation member. As shown, hollow cross-member 109 has a threaded end 701 which is positioned in a corresponding through-hole 703 of flotation member 105. Threaded end 701 is then fixed in position by nut 705. As shown in this example, cross-member 109 also contains shoulder 707 which abuts against a matching shoulder 709 when inserted into through-hole 703. Thus, cross-member 109 can maintain position within flotation member 105 while maintaining its hollow configuration and open end. In the example shown in FIG. 7, nut 705 engages directly with threaded end 701 to press against outer surface 511 of flotation member 105. Alternatively, one or more washers or other intermediate elements can be positioned between nut 705 and outer surface 511 in order to protect outer surface 511 from nut 705. In this example, nut 705 and shoulder 709 act as two members or surfaces for compressing flotation member 105.

Figure 8:
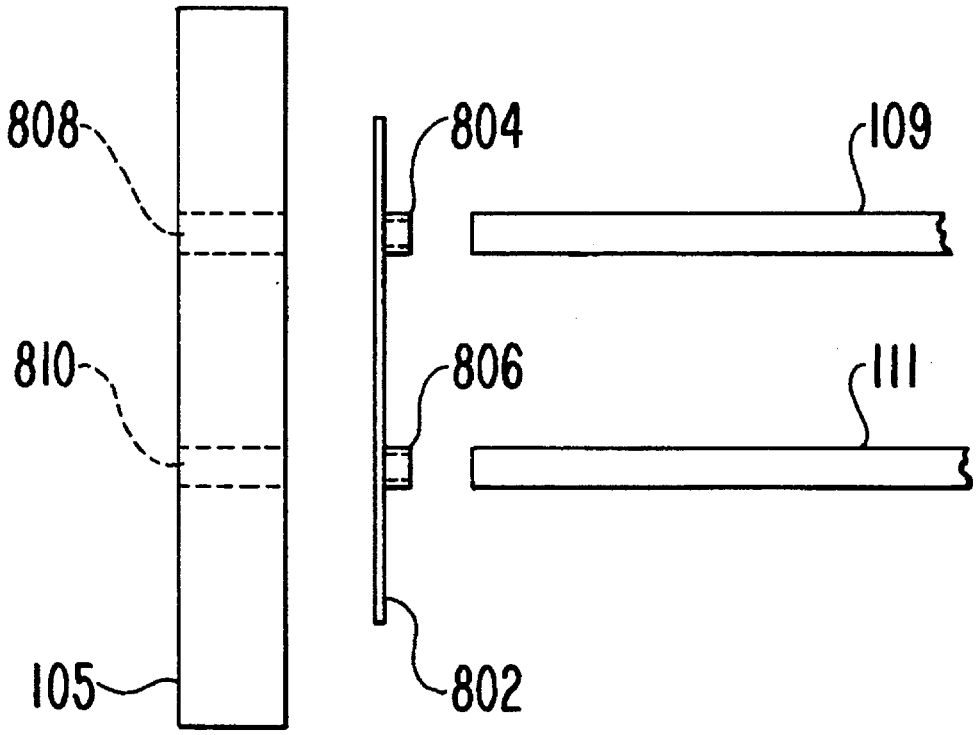
FIG. 8 shows an alternative example of a connection between a cross-member and a flotation member according to a sixth embodiment of the invention.

FIG. 8 shows another method of interconnecting flotation members 105 and 107 with cross-members 109 and 111. Plate 802, which is preferably made from plastic, has two hollow knobs 804 and 806. Plate 802 is then attached to flotation member 105 such that hollow knobs 804 and 806 align with through-holes 808 and 810 of flotation member 105. Plate 802 is preferably attached to flotation member 105 via an adhesive. A similar plate is connected to flotation member 107. Cross-members 109 and 111 are then mated with hollow knobs 804 and 806 by any conventional means, such as press-fitting, adhesive, clamping, through-screws, or any combination thereof.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A skimmer comprising:

first and second flotation members;

first and second hollow cross members attached to said first and second flotation members in a substantially vertical orientation with ends of the cross members being substantially open with respect to an outer surface of the flotation members, such that one cross member is capable of being submerged and filled with liquid, providing stability, while the other cross member is empty; and a net operatively connected to the first and second hollow cross members.

2. A skimmer as recited in claim 1, wherein the first and second hollow cross-members are positioned in corresponding through-holes in the first and second flotation members, such that the open ends of the first and second hollow cross-members are positioned to be open with respect to outside surfaces of the first and second flotation members.

3. A skimmer as recited in claim l, further comprising an omnidirectional pulling element coupled to the first and second flotation members.

4. A skimmer as recited in claim 3, wherein the omnidirectional pulling element comprises:

for each flotation member, a traverse slot connected between a first end section of the flotation member and a second end section of the flotation member; and a traversing line slidably connected at one end to the traverse slot of one flotation member, and at the other end to the traverse slot of the other flotation member.

5. A skimmer as recited in claim 2, wherein each end of each hollow cross-member includes an inner support member and an outer support member, the inner support member and outer support member of each end of each cross-member having a substantially perpendicular orientation with respect to a longitudinal axis of the corresponding cross-member, such that the inner support member and outer support member maintain the cross-member in the corresponding through-holes of the first and second flotation members.

6. A skimmer as recited in claim 5, wherein at least one of the inner support members comprises a dowel positioned in a corresponding through-hole in the corresponding end of the corresponding cross-member.

7. A skimmer as recited in claim 5, wherein at least one of the outer support members comprises a dowel positioned in a corresponding through-hole in the corresponding end of the corresponding cross-member.

8. A skimmer as recited in claim 5, wherein at least one of the outer support members comprises a nut threadably engaged with an outer surface of the corresponding end of the corresponding cross-member.

9. A skimmer as recited in claim 1, wherein the net includes a first hem at a first end for operative connection to the first hollow cross-member and a second hem at a second end for operative connection to the second hollow cross-member.

10. A skimmer as recited in claim 1, wherein the net has a length which is at least the length of the first and second flotation members.

11. A skimmer as recited in claim 1, wherein the first and second flotation members have symmetrical shapes.

12. A skimmer as recited in claim 1, wherein the first flotation member has an elongated longitudinal shape with a center portion expanded laterally with respect to a longitudinal axis.

13. A skimmer as recited in claim 12, wherein the first flotation member has rounded ends and the center portion is tapered.

14. A skimmer as recited in claim 12, wherein the first flotation member has two end sections and the center portion has a depth at least 1.5 times a depth of the end sections.

15. A skimmer as recited in claim 1, wherein the first and second flotation members are made from foam, and the first and second cross-members are made from PVC pipe.

16. A skimmer as recited in claim 1, further comprising a first plate connected to an inside surface of the first flotation member and a second plate connected to an inside surface of the second flotation member, each of the first and second plates having a first hollow knob and a second hollow knob, the first hollow knob of each plate being connected to a corresponding end of the first hollow cross-member, and the second hollow knob of each plate being connected to a corresponding end of the second hollow cross-member.

17. A skimmer, comprising:

a first flotation member;

a second flotation member;

first end second hollow cross-members, each having a first end connected to the first flotation member and a second end connected to the second flotation member; and a net operatively connected to the first hollow cross-member and the second hollow cross-member, wherein the first and second hollow cross-members have open ends and an omnidirectional pulling element coupled to the first and second flotation members, wherein the omnidirectional pulling element comprises:

for each flotation member, a traverse line connected between a first end section of the flotation member and a second end section of the flotation member; and a traversing line slidably connected at one end to the traverse line of one flotation member, and at the other end to the traverse line of the other flotation member.

18. A skimmer, comprising a first flotation member;

a second flotation member;

first and second hollow cross-members, each having a first end connected to the first flotation member and a second end connected to the second flotation member; and a net operatively connected to the first hollow cross-member and the second hollow cross-member, wherein the first and second hollow cross-members have open ends, wherein the first flotation member has an elongated longitudinal shape with a center portion expanded laterally with respect to a longitudinal axis, and wherein the second flotation member has an elongated longitudinal shape with a center portion expanded laterally with respect to a longitudinal axis.

19. A pool skimmer, comprising:

a first foam flotation member having a symmetrical shape;

a second foam flotation member having a symmetrical shape;

a first PVC pipe connected between the first and second foam flotation members, such that a first open end of the first PVC pipe is open with respect to an outer surface of the first foam flotation member and a second open end of the first PVC pipe is open with respect to an outer surface of the second foam flotation member;

a second PVC pipe connected between the first and second foam flotation members, such that a first open end of the second PVC pipe is open with respect to the outer surface of the first foam flotation member and a second open end of the second PVC pipe is open with respect to the outer surface of the second foam flotation member;

a net having a first hem connected to the first PVC pipe and a second hem connected to the second PVC pipe;

a first traverse line connected between a first end section of the first foam flotation member and a second end section of the first foam flotation member;

a second traverse line connected between a first end section of the second foam flotation member and a second end section of the second foam flotation member; and a traversing line slidably connected at a first end to the first traverse line, and slidably connected at a second end to the second traverse line.

* * * * *